United States Patent [19]

Harrington

[11] Patent Number: 4,503,635

[45] **Date of Patent: * Mar. 12, 1985**

[54] FLYING DISC WITH WEIGHTED OUTER RING

[76] Inventor: Richard H. Harrington, 631 Third St., Ann Arbor, Mich. 48103

[ * ] Notice: The portion of the term of this patent subsequent to May 27, 1997 has been disclaimed.

[21] Appl. No.: 364,432

[22] Filed: Apr. 1, 1982

Related U.S. Application Data

[63] Continuation-in-part of Ser. No. 157,464, May 29, 1980, , which is a continuation of Ser. No. 808,593, Jun. 21, 1973, Pat. No. 4,204,357.

[51] Int. Cl.[3] ..... A63H 27/00

[52] U.S. Cl. ..... 446/46; 273/424

[58] Field of Search ..... 46/74 D; 273/424, 425

[56] References Cited

U.S. PATENT DOCUMENTS

| | | | |
|---|---|---|---|
| 3,724,122 | 4/1973 | Gillespie, Sr. | 46/74 D |
| 3,852,910 | 12/1974 | Everett | 46/74 D |
| 3,948,523 | 4/1976 | Michael | 46/74 D |
| 3,982,489 | 9/1976 | Flatau et al. | 273/425 |
| 4,115,946 | 9/1978 | Vukmirovich | 46/74 D |
| 4,132,030 | 1/1979 | Lehman | 46/74 D |
| 4,151,674 | 5/1979 | Klahn | 46/74 D |
| 4,151,997 | 5/1979 | Glovak et al. | 273/425 |
| 4,176,843 | 12/1979 | DeWitt, Jr. | 46/74 D |
| 4,204,357 | 5/1980 | Harrington | 46/74 D |
| 4,207,702 | 6/1980 | Boatman et al. | 46/74 D |
| 4,216,611 | 8/1980 | Psyras | 273/424 |
| 4,246,721 | 1/1981 | Bowers | 273/425 |
| 4,254,575 | 3/1981 | Gould | 46/74 D |
| 4,320,593 | 3/1982 | Sarkis | 273/424 |
| 4,334,385 | 6/1982 | Mislin et al. | 273/424 |

FOREIGN PATENT DOCUMENTS

| | | | |
|---|---|---|---|
| 519145 | 6/1921 | France | 273/424 |

*Primary Examiner*—Paul J. Hirsch

*Attorney, Agent, or Firm*—Donald P. Gillette

[57] ABSTRACT

A molded flying disc with most of the weight concentrated in an outer annular ring and the central area in the ring covered by a thin lightweight sheet of material different from the molded material of the same thickness and diameter. The ring has a locking structure to hold an interlocking weight ring that may include another locking structure to hold an additional weight ring. The lightweight sheet may be colored or have artwork, such as a hologram, thereon.

9 Claims, 14 Drawing Figures

46
39
51
34
44
56
49
52
53
57
48
59
47
54
58

78
73
84
83
86
34
69
67
63
65
74
77
82
64
76
68
62
60
61
71
79
72
81

102
103
97
34
87
91
93
94
92
89
88
96

97
101
102
103
34
87
91
93
94
92
89
88
96
99
98

104
111
108
109
106
107

FIG-13
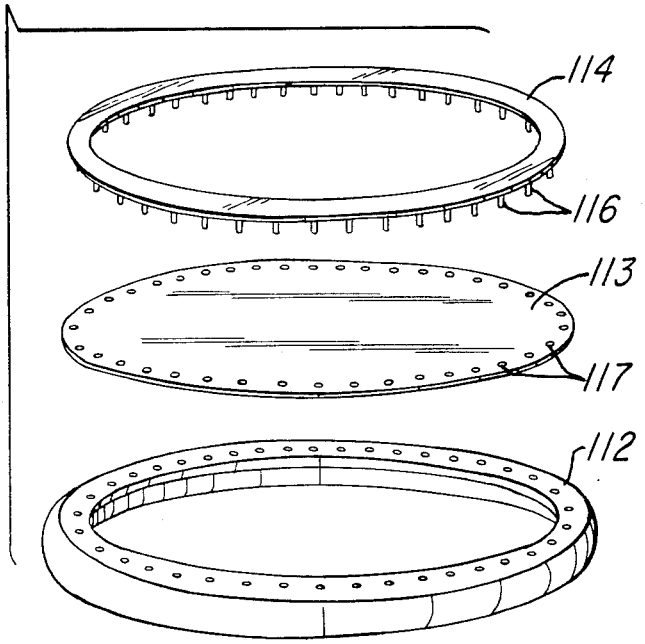
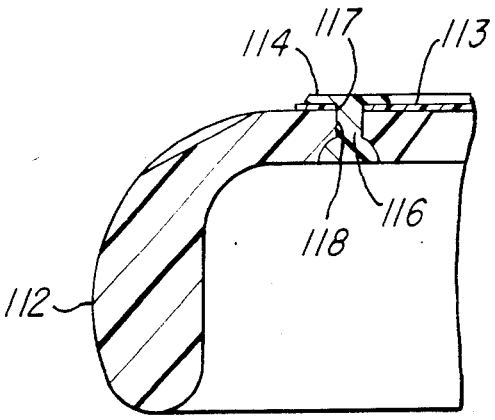
FIG-11
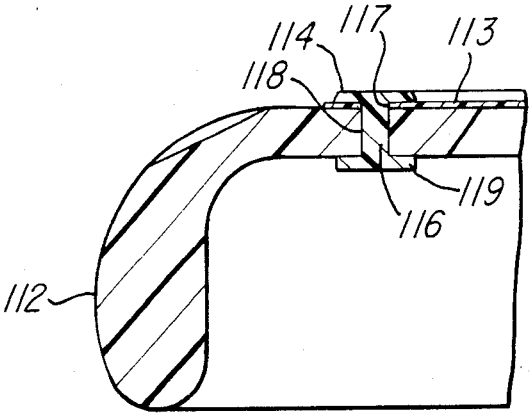
FIG-12

FLYING DISC WITH WEIGHTED OUTER RING

This application is a continuation-in-part of U.S. Ser. No. 157,464, filed May 29, 1980, which in turn is a continuation of U.S. Ser. No. 808,593 filed June 21, 1973, now U.S. Pat. No. 4,204,357.

BACKGROUND OF THE INVENTION

1. Field of the Invention

This invention relates to flying discs of a type thrown by hand in a way that causes them to have both forward and angular momentum. In particular, the invention relates to providing such discs with at least one surface that interlocks with a properly shaped surface of a weight ring to hold the weight ring firmly in place in spite of the typical, severe jolts to which the disc is subjected in use.

2. The Prior Art

The type of disc with which this invention is concerned has a lightweight but strong central membrane, or web, with a molded, outer, annular rim curved away from the web to form a more or less cylindrical outer wall. Together, the web and the rim have the form of a shallow dish. The edge of the rim has a rounded cross section resembling an air foil. The thickest part of the air foil measured in the usual direction of measurement of thickness of an air foil, that is, perpendicular to the chord, and in this invention approximately parallel to the plane of the web, is not immediately adjacent the edge farthest from the web but is perhaps one-third or so of the distance from the edge to the web. The inwardly facing surface of the air foil section of existing discs is substantially flat in cross section and defines a generally cylindrical surface. The annular rim consists primarily of a suitable thermoplastic material, such as polyethylene, and the cylindrical configuration of the facing surface of the rim makes it easy to remove the annular ring from the mold.

Interest in the type of discs with which this invention is concerned is based on their flight characteristics. The shape of the disc gives it lift, when properly thrown, so that it does not simply sink to the ground as would a smooth, spherical ball of the same mass thrown with the same force. Some enthusiasts try to throw such a disc so that if flies as far as possible, and contests are held for that purpose. A more casual and probably more common usage is for enthusiasts to throw a flying disc of the shallow dish type back and forth to each other, either keeping the disc in the air or bouncing it off the ground somewhere between the players. Another way of enjoying the discs is for players to try to cause them to follow unusual, curved flight paths. Still another thing that enthusiasts do with the discs is to "tip" them, which is defined as hitting the under surface of a spinning disc in the center by means of the player's finger tip, knuckle, or toe. The stress on a disc due to tipping it can be severe.

As might be expected, the various requirements of different players have led to different designs of such discs. A main difference is in the weight, which may be as light as about 110 grams or as heavy as about 180 grams. Wind conditions have an important bearing on the particular disc an enthusiast will select at a given time; heavier ones are usually preferred in windy weather.

Although polyethylene does not shatter as would a more brittle material, it can be nicked, particularly when it is bounced off a paved surface or flies into an abrasive surface. The resulting projections from the originally smooth surface can make the disc painful to catch.

The flight characteristics of a flying disc are affected by the air foil and surface configuration, especially on the convex surface. Such discs are normally thrown with the rim extending downwardly from the plate, which is equivalent to saying that the convex surfaces face partially outwardly and partially upwardly. For this reason the convex surfaces of the ring will be referred to as the upper ones and the concave and inwardly facing surfaces as the lower ones in the following description.

It has been found desirable to mold spoilers in the upper surface of a flying disc near the outer part thereof to reduce air drag and improve precessional qualities of the disc. U.S. Pat. No. 3,359,678 to Headrick describes concentric ridges that act as spoilers to interfere with air flow.

Other publications that describe characteristics of Frisbees are the book FRISBEE by Stancil E. D. Johnson, M.D. published by Workman Publishing Company, N.Y., and a paper entitled "Adaptation of the Frisbee Flight Principle to Delivery of Special Ordinance" by G. D. Stilley of Honeywell Incorporated and D. L. Carstens of the Naval Ammunition Depot, Crane, Indiana, and presented at the AIAA 2nd Atmospheric Flight Mechanics Conference at Palo Alto, Calif., Sept. 11–13, 1972 (AIAA) Paper No. 72–982).

My U.S. Pat. No. 4,204,357 and copending application Ser. No. 154,484 describe discs that include generally radial spoilers and a structure comprising an annular ring with an air foil and a central web of lighter weight than the usual polyethylene molded center that the web replaces. It is also taught that the moment of inertia of the disc can be further increased by adding weight rings inside or outside of the rim at the outer perimeter of the annular ring.

OBJECTS AND SUMMARY OF THE INVENTION

It is one of the objects of this invention to provide a flying disc with attachment means to adjust the flight characteristics.

Another object is to provide a disc of improved strength-to-weight ratio.

A still further object is to increase the moment of inertia of a flyable toy disc.

Yet another object is to provide a disc on which individual art work can be printed photographically, including the production of holographic images.

Other objects will become apparent from the following detailed description and claims and the associated drawings.

In accordance with this invention, a flying disc comprising two main parts is formed by attaching the perimeter of a thin, lightweight, strong web to the inner perimetric region of an annular molded ring. The resultant structure will be referred to hereinafter as a two-part disc, although it may include additional important, but smaller, parts. The web consists of material that is stronger for a given thickness than the material of which the ring is molded. Therefore, a greater part of the weight is concentrated near the perimeter than in the case of a one-part disc molded of the outer ring material. This gives such a two-part disc a greater moment of inertia than a one-part disc of the same total weight.

The rim of the ring is curved away from the plane of the web and has a generally cylindrical inner surface. To increase the moment of inertia of the disc a weight ring can be fitted to the rim, and to hold the weight ring in place, the juxtaposed surfaces of the weight ring and the rim are formed to interlock with each other. The surface configurations can be in the form of matching flanges and grooves, pins and recesses, or other interlocking structures. Interlocking the weight ring and the rim holds them together firmly enough to withstand the sharp jolts encountered by such discs in normal usage.

The inner surface of the weight ring may be provided with interlocking structures to allow another weight ring to engage it to increase the moment of inertia still more.

BRIEF DESCRIPTION OF THE DRAWINGS

FIGS. 11 and 12 are cross-sectional views of modified forms of disc construction.

FIG. 13 is an exploded, prespective view of the disc in FIG. 11.

DETAILED DESCRIPTION OF THE INVENTION

Figure 1:
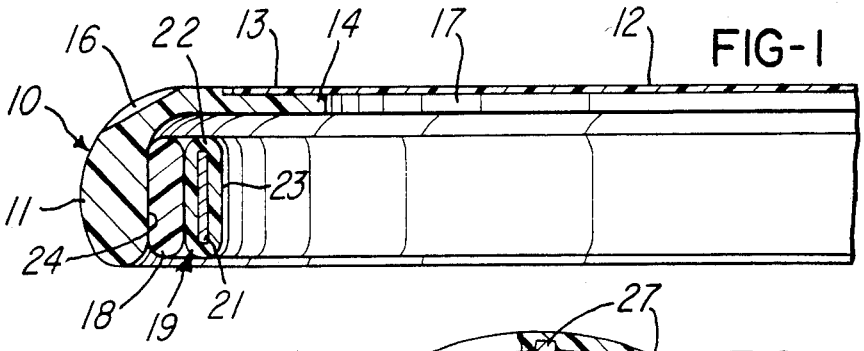
FIG. 1 is a cross-sectional view of a fragment of a flying disc with press-fitted weight rings.
Figure 2:
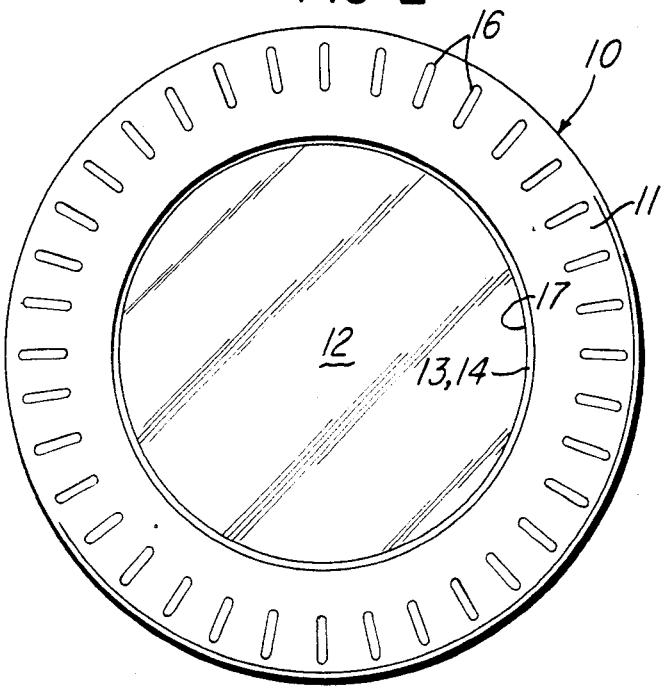
FIG. 2 is a top view of the disc in FIG. 1.

FIG. 1 shows part of a cross-section of a weighted disc 10 comprising an annular member, or ring, 11 and a circular central sheet, or web, 12, the outer region 13 of which is joined by adhesive means to the radially inner part of the ring 11. The inner region 14 of the ring 11 may be recessed slightly, as shown, to protect the edge of the web 12. The upper surface of the ring has a circular array of narrow spoiler grooves 16 formed in it, each of which is much longer than it is wide and extends in a substantially radial direction, as shown in FIG. 2.

The web 12 covering the central opening 17 in the ring 11 is formed of strong, lightweight material, such as Mylar or Estar brand film (a trademark of Eastman Kodak, Co.), or similar polyester film that has a good strength-to-weight ratio, or a film of other suitable material, such as acrylic materials or polycarbonate materials, or a laminate of polyethylene and polyester. Mylar and other plastic films of similar nature are strong enough to be satisfactory if they are of the order of about 0.007" to about 0.011" thick, which is thinner than even the thinnest polyethylene web that can be satisfactorily molded integrally with the annular outer section 11.

A Mylar web 12 with a thickness of only 0.007" formed of layers of 0.003" laminating material weighs approximately 12 grams and can replace the integrally molded central web portion weighing about 50 grams in one-part discs, thus resulting in a weight reduction of about 24%. Since the reduction of weight is in the central region and not in the outer ring, the weight of the latter automatically is a greater percentage of the total weight, which yields longer flight times, slower velocity, and slower drop rate of the two-part disc 10 than a similarly shaped one-part disc of the same total weight but with a greater percentage of that weight in the integrally molded central portion. Thus, two players throwing a two-part disc 10 back and forth to each other have more time to catch it. Furthermore, the Mylar or other plastic web 12 is very smooth, which reduces drag and results in flights of still greater distance.

The outer perimetric region 13 of the web 12 may be glued to the upper surface of the inner perimeter of the ring 11 by an adhesive such as neoprene with 1,1,1-trichloroethane as a thinner. The region 14 of the polyethylene ring 11 to which the web 12 is to adhere is oxidized, either chemically or by being directly heated with a flame just long enough to make that part of the surface of the ring slightly shiny. As an example of one way to apply the flame, the ring 11 may be mounted on a turntable and rotated at about 20 to 100 r.p.m. for several seconds, time enough for the turntable to rotate from about two to twenty revolutions, with a propane gas flame playing on the upper surface to be oxidized. The oxidized inner region 14 of the ring 11 is coated with the adhesive, as is the part of the web 12 to be joined to the ring, and the adhesive is allowed to dry for about 15 minutes to 3 hours on the web and the ring before they are brought into contact with each other. Then the adhesive-coated outermost annular part 13 of the web 12 is pressed against the adhesive-coated innermost annular part 14 of the ring 11 with a pressure of about 250 to 1000 lb./sq. in. for about 10 seconds or longer. A pressure of 500 lb./sq. in, for 15 seconds has been found quite satisfactory.

FIG. 1 shows a disc with two weight rings 18 and 19. The rings 18 and 19 may each be graded in some specific weight ratio, such as 10 gram intervals. For example, the ring 18 may be molded of polyethylene in 10 grams, 20 gram, and 30 gram weights. The ring 19, as shown, consists of a loop of steel 21 that is 0.25" wide and 0.010" to 0.020" thick enclosed in a ring 22 of polyehtylene. In fact the ring 19 may also be molded entirely of polyethylene. The rings 18 and 19 are molded to have a tight interference fit with the down-turned rim of the ring 11. Because of the elasticity of polyethylene, the diameter of the inner surface 23 of the ring may be molded to be the same as the diameter of the substantially cylindrical surface 24 of the ring 11. If the ring 19 is made entirely of polyethylene, it may be molded to be identical with the ring 18.

The weight rings 18 and 19 are less inclined to remain deformed than are one-part discs. If deformed in any direction, they spring back immediately into their proper shape, which minimizes wobbling of the disc 10 during flight.

Figure 3:
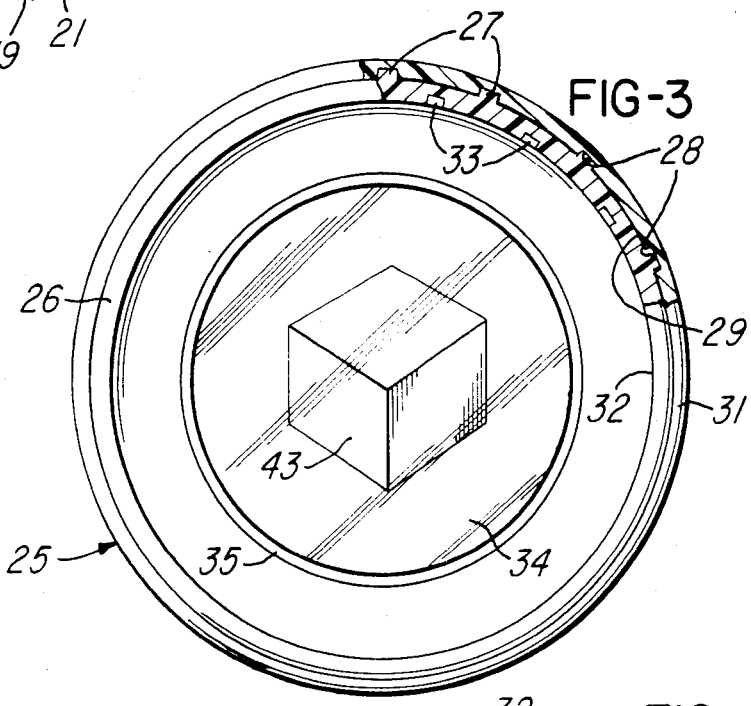
FIG. 3 is a view of the underside of one embodiment of a disc and weight ring according to this invention with parts of the disc and ring broken away to show how they fit together.
Figure 4:
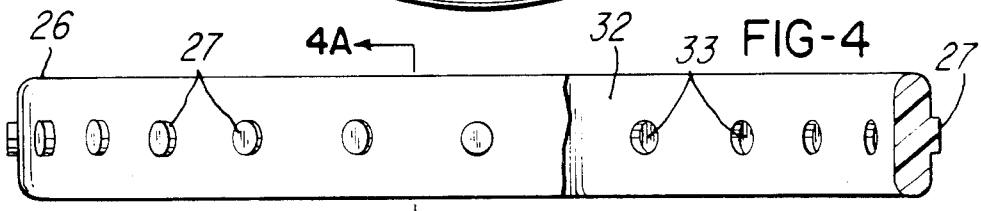
FIG. 4 is a side view of the ring in FIG. 2, partially broken away to reveal the cross-sectional shape.
Figure 5:
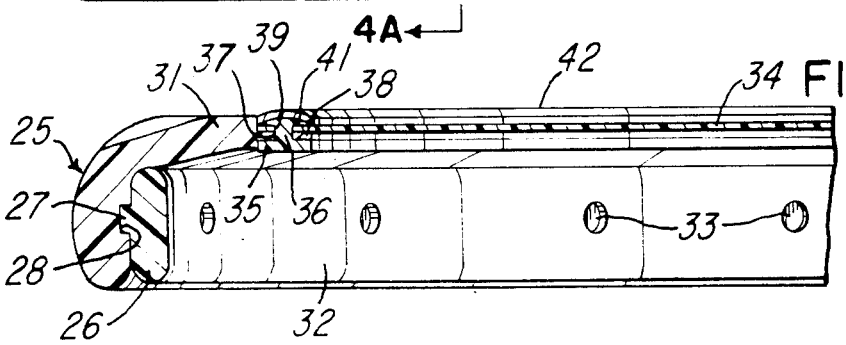
FIG. 5 is an enlarged cross-sectional view of the ring and disc in FIG. 2.

FIGS. 3–5 show a modified flying disc 25 and a weight ring 26 provided with interlocking means in the form of short cylindrical projections 27 that fit into recesses 28 in the generally cylindrical inner surface 29 of the annular ring portion 31 of the disc 25. There are enough pins 27 to hold the weight ring 26 firmly interlocked with the annular ring 31; approximately 25 to 50 such pins, each about 0.020" to about 0.060" in height and about 0.25" in diameter. The recesses 28 must be large enough to accommodate the pins with a slight amount of looseness.

The inner surface of the ring 26 may have the same diameter as the inner surface 29 of the ring 31, since the rings 26 and 31 are of elastomeric material, such as polyethylene, and the surface 32 may also be provided with recesses 33 similar to the recesses 28 to interlock with another ring like the ring 26.

Figure 4A:
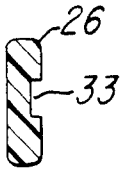
FIG. 4*a* shows the cross-section of the ring in FIG. 4 at the palne 4A—4A in FIG. 4.

FIG. 4 shows the ring 26, alone. Part of the ring has been broken away to show the cross-section through one of the pins 27. On the inner surface 32 are the recesses 33, one of which is shown in the cross-sectional view in FIG. 4A.

The disc 25 is very similar to the disc 10 in FIGS. 1 and 2 in its overall appearance. Apart from the recesses 28, it differs from the disc 10 only in that the perimeter of a web 34 is held attached to the under surface of the annular ring 31 by a ring 35. As is shown in FIG. 5, the ring 35 has a plurality of pins 36 extending through holes 37 in the region 38 adjacent the inner perimeter of the ring 31. The pins also extend through holes 39 near the perimeter of the web 34 and are flattened by heat and pressure to form an enlarged end 41 on each pin. A protective annular cover 42 is glued over the enlarged ends of the pins 36.

The flexibility of the weight ring 26 allows part of it to be temporarily bent radially inwardly so that it can fit inside the surface 29. Then, the projections 27 on one part of the weight ring can be fitted into the recesses 28 and the inwardly bent part can be allowed to expand so that all of the projections 27 can engage the recesses 28.

Still another advantage of Mylar or a similar smooth web 12 is that it can be a suitable photographic base on which to reproduce artistic designs or personal photographs or commercial messages. FIG. 3 shows a simple design 43 that may be printed on the web 34 to make the web more colorful. The design 43 may be in color and can be formed as a three-dimensional holographic representation. Personal photographs can be printed on a Mylar or a like film, such as Kodak Extracolor I.D. Print Material #4023 with a white back Estar base, to provide incontrovertible proof of ownership in case the disc is commingled with other discs on a beach or other public play area. Designs on the plastic web 34 can also be printed by silk screening.

Figure 6:
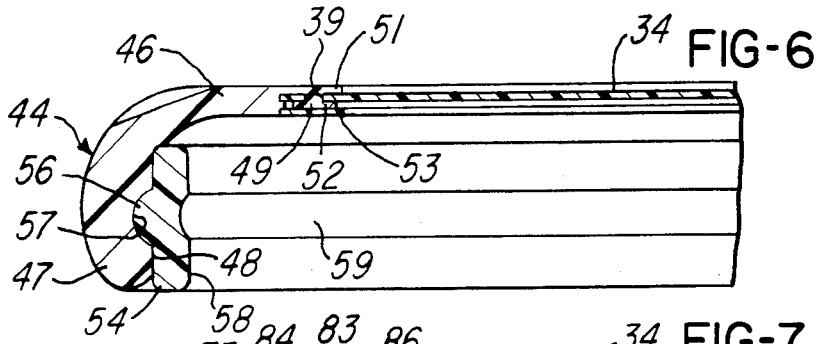
FIG. 6 is an enlarged cross-sectional view of a fragment of a modified embodiment of a disc and weight ring according to this invention.

FIG. 6 shows a modified embodiment in which a disc 44 has an outer ring 46 with a rim 47 that has a generally cylindrical inner surface 48. The web 34, identical with the web 34 in FIG. 5, has the same holes 39, but they are fitted over pins 49 that extend downwardly from the under surface of the inner perimetrical region 51 of the ring 46. Each pin 49 has an enlarged head 52 and all of the enlarged heads are covered by an annular member 53 glued in place.

In FIG. 6 a weight ring 54 is provided with interlocking means in the form of a rounded flange 56 that fits into a channel 57 of matching configuration in the generally cylindrical surface 48. As in the other embodiments, the inner surface 58 of the ring 54 may have a channel 59 just like the channel 57 to hold another weight ring.

Figure 7:
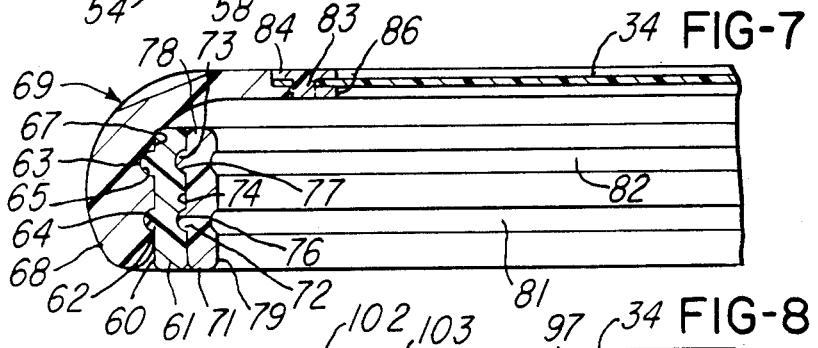
FIG. 7 is an enlarged cross-sectional view of a fragment of a further madification of the invention.

FIG. 7 shows another embodiment similar to that in FIG. 6 except that the outer surface 60 of a first weight ring 61 has two rounded flanges 62 and 63 that engage matching grooves 64 and 65 in the substantially cylindrical inner surface 67 of an annular ring 68 that forms part of a disc 69. A second weight ring 71 has rounded flanges 72 and 73 on its outer surface 74 to interlock with matching channels 76 and 77 in the inner surface 78 of the outer weight ring 61. The inner surface 79 of the ring 71 has channels 81 and 82 to hold still another weight ring, if desired.

The web 34 in FIG. 7 is held in place by pins 83 that extend from a ring 84 and are sonically welded in holes in the innermost part 86 of the ring 68. The ring 84 and the ring 68 thus essentially form a single member.

Figure 8:
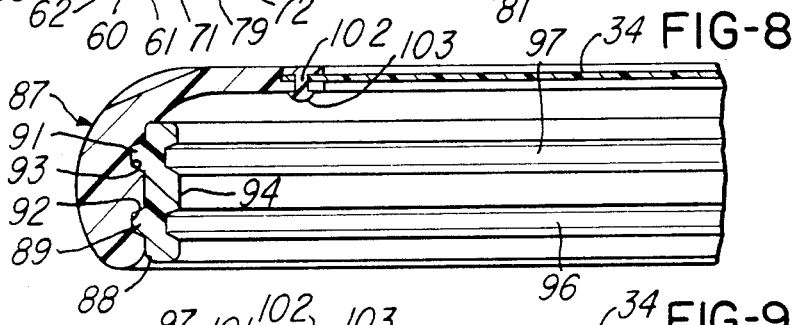
FIG. 8 is a cross-sectional view of a fragment of another embodiment of a disc and weight ring according to this invention.
Figure 9:
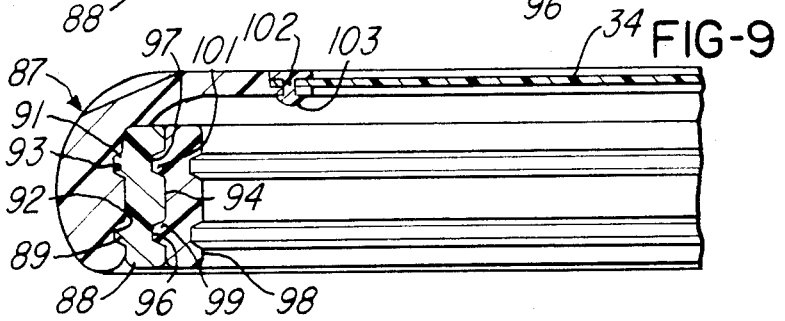
FIG. 9 is a cross-sectional view of a modified embodiment of the components shown in FIG. 7.

FIGS. 8 and 9 show a disc 87 similar to the disc 69 in FIG. 7 except that a weight ring 88 in disc 87 has flanges 89 and 91 of more nearly rectangular cross-section. Actually the cross-section of the flanges 89 and 91 is slightly tapered for better mold release and to allow the weight ring 88 to be inserted more easily into the disc 87. The latter has grooves 92 and 93 shaped to receive the flanges 89 and 91.

The inner surface 94 of the ring 88 has grooves 96 and 97 to receive flanges of a second weight ring. Such a ring 98 is shown in FIG. 9 and has flanges 99 and 101 to fit into the grooves 96 and 97.

In FIG. 8 the web 34 is held in place by pins 102 with enlarged heads 103, which are not covered as similar pins were in other embodiments. In FIG. 9 the web 34 is held in place by the same structure as in FIG. 7.

Figure 10:
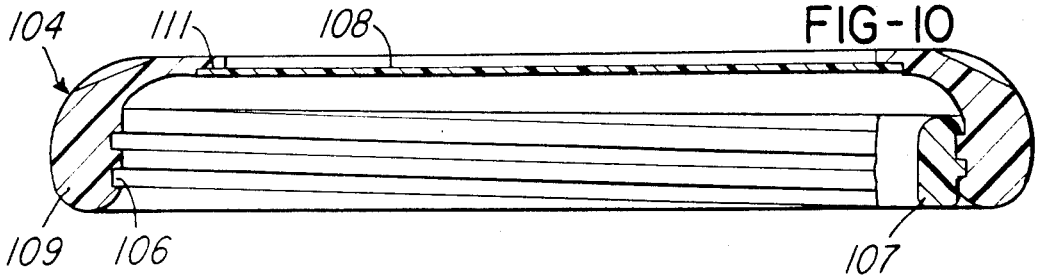
FIG. 10 is a cross-sectional view of a further modification of the embodiment in FIG. 7.

FIG. 10 shows an embodiment of a disc 104 that has a helical groove 106 of rectangular cross-section to receive a similarly threaded weight ring 107, only a small part of which is shown. This weight ring need not be as flexible as the weight rings in the other embodiments. Those weight rings must be bent to force them into position. The weight ring 107 can be stiff and, since it is protected by the disc 104, can even be of metal. The slope of the thread of the groove 106 is so slight that the weight ring is not likely to work itself out easily. The disc 104 has a central web 108 similar to the web 12 in FIGS. 1 and 2 in that it is glued directly to the annular ring portion 109 of the disc. However, unlike the structure in FIG. 1, the outermost region 111 of the web 108 is glued to the underside of the annular ring 109.

FIG. 11 shows a modified annular ring 112 with a central web 113 of material similar to the webs in any of the previously described embodiments. The web 113 is held in place by a ring 114 with pins 116 that extend through holes 117 in the web and holes 118 in the rim 112. The holes 118 are tapered, and the plastic material used to make the ring 114 and pins 116 can be heated and then compressed axially to expand outwardly into a flared shape that fits the tapered holes 118. The proper choice of the amount of material in the pins 116, the axial compression can cause the pin material to fill the tapered holes almost exactly.

The structure in FIG. 12 is very similar to that in FIG. 11 except that the pins 116 are sonically welded to an inner ring 119 so that the outer ring 114, the pins 116, and the inner ring 119 become virtually a single member.

FIG. 13 shows the structure of FIG. 11 aligned for assembly. The ring 114 is at the top with its pins 116 pointing directly downwardly toward the holes 117 in the web 113. Below the web 113 is the annular ring portion 112 with its holes aligned with the holes 117 and the pins 116.

The ring 112 in FIGS. 11–13 can have any of the inner surface configurations described in the preceding embodiments as being suitable for holding one or more weight rings in place.

While this invention has been described in terms of specific embodiments, it will be understood by those skilled in the art that modifications may be made therein with the scope of the invention as defined by the following claims.

What is claimed is:

1. A flying disc comprising:

an annular member molded of a first material, the inner perimeter of the annular member defining an open inner area in a plane, and the annular member comprising an outer rim with an air-foil-shaped cross-section curved away from the plane defined by the inner perimeter and having a convex outwardly facing surface, the outer rim having an inwardly facing surface;

a thin, flat sheet of a different material having a higher strength-to-weight ratio for its thickness than the first material at the same thickness and having an outer perimeter affixed to the annular member to cover the open inner area; and a weight ring comprising an outwardly facing surface, the outwardly facing surface of the weight ring and the inwardly facing surface of the rim comprising interlocking means to hold the weight ring connected to the rim.

2. The disc of claim 1 in which the annular member and the weight ring are molded of elastomeric material, and the weight ring, as molded, has an inwardly facing surface with substantially the same diameter as the inwardly facing surface of the rim.

3. The disc of claim 2 in which the inwardly facing surface of the weight ring has substantially the same configuration as the inwardly facing surface of the rim.

4. The disc of claim 1 in which the interlocking means comprises matching pins and recesses.

5. The disc of claim 1 in which the interlocking means comprises matching grooves and flanges.

6. The invention of claim 5 in which the flanges have cross sections that are substantially shaped like circular segments.

7. The invention of claim 5 in which the flanges have tapered cross sections.

8. The invention of claim 5 in which the flanges have substantially rectangular cross sections.

9. The invention of claim 1 in which the interlocking means comprises male and female threaded surfaces.

* * * * *